US012092441B2

(12) United States Patent
Gaide

(10) Patent No.: US 12,092,441 B2
(45) Date of Patent: Sep. 17, 2024

(54) AMMUNITION CARTRIDGE

(71) Applicant: Rabuffo SA, Monnaz (CH)

(72) Inventor: Albert Gaide, Monnaz (CH)

(73) Assignee: Rabuffo SA, Monnaz (CH)

( * ) Notice: Subject to any disclaimer, the term of this patent is extended or adjusted under 35 U.S.C. 154(b) by 0 days.

(21) Appl. No.: 18/682,484

(22) PCT Filed: Aug. 3, 2022

(86) PCT No.: PCT/EP2022/071815
§ 371 (c)(1),
(2) Date: Feb. 9, 2024

(87) PCT Pub. No.: WO2023/016886
PCT Pub. Date: Feb. 16, 2023

(65) Prior Publication Data

US 2024/0263927 A1 Aug. 8, 2024

(30) Foreign Application Priority Data

Aug. 13, 2021 (EP) ..... 21191408

(51) Int. Cl.
*F42B 5/285* (2006.01)
*F42B 33/00* (2006.01)

(52) U.S. Cl.
CPC ..... *F42B 5/285* (2013.01); *F42B 33/001* (2013.01)

(58) Field of Classification Search
CPC ..... F42B 5/285; F42B 5/307; F42B 33/00
See application file for complete search history.

(56) References Cited

FOREIGN PATENT DOCUMENTS

| | | | |
|---|---|---|---|
| DE | 3923461 | 1/1991 | |
| EP | 0186904 A1 * | 9/1986 | ..... F42B 5/285 |
| EP | 3201558 | 8/2017 | |
| FR | 2376395 | 7/1978 | |
| WO | WO-2019166226 A1 * | 9/2019 | ..... F42B 5/285 |

OTHER PUBLICATIONS

International Search Report and Written Opinion issued by the International Searching Authority, dated Nov. 18, 2022, for International Patent Application No. PCT/EP2022/071815; 11 pages.

* cited by examiner

*Primary Examiner* — Jonathan C Weber
(74) *Attorney, Agent, or Firm* — Faegre Drinker Biddle & Reath LLP

(57) ABSTRACT

A multi-part casing for an ammunition cartridge comprising a tubular sleeve and a base, the base assembled and fixed to the tubular sleeve by a weld arrangement. The base comprises an end wall having a rim, an extraction groove adjacent the rim, and a tubular extension extending from the end wall and having an outer surface in contact with an inner surface of a base end of the tubular sleeve. The welding arrangement comprises a weld line that spirals around the base end of the tubular sleeve from a weld line start point positioned over the tubular extension of the base spiraling to a weld line end section positioned over the extraction groove, a surface portion of the extraction groove interfacing with the tubular sleeve having a machined surface such that the weld line ends in the machined surface.

17 Claims, 4 Drawing Sheets

AMMUNITION CARTRIDGE

CROSS-REFERENCE TO RELATED APPLICATIONS

Figure 1:
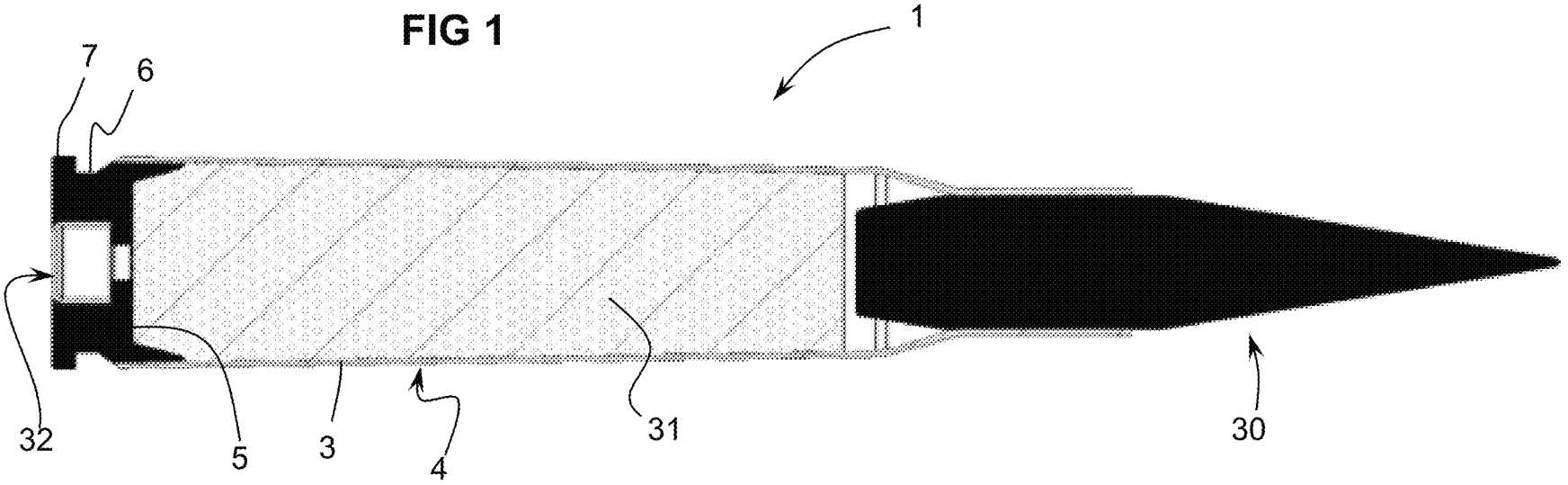

The present application is a national stage entry of International (PCT) Patent Application Number PCT/EP2022/071815, filed Aug. 3, 2022, which claims priority to European Patent Application Number 21191408.0, filed Aug. 13, 2021, the complete disclosures of which are expressly incorporated herein by reference.

FIELD OF THE INVENTION

The present invention relates to an ammunition cartridge having a welded multi-part casing and a method of manufacturing thereof.

BACKGROUND OF THE INVENTION

Conventional ammunition cartridges for firearms and guns of various sizes and purposes typically comprise a single-part deep drawn or a multi-part assembled casing containing a propellant charge in the form of powder or granules of a combustible substance, and a projectile assembled in a gripping fit at an open tubular sleeve end of the casing.

Ammunition cartridges with two-part casings have some advantages over single-part casings. Single-part casings are typically deep-drawn brass casings, which exhibit a variable wall thickness, from thin at the projectile end to thicker at the base end in view of the manufacturing process. They thus have a greater mass than two-part casings where the cartridge tubular sleeve has a constant thickness wall. Also, two-part casings may be made of stainless steel which due to the higher resistance may have thinner walls and lower mass. Another advantage of two-part casings is that in view of the thinner walls of the tubular sleeve part, there is a greater volume inside the casing for storing a larger quantity of propellant for a given outer geometry determined by the weapon with which the ammunition is intended to be used.

In multi-part (in particular two-part) ammunition casings having a tubular sleeve and separate base assembled and fixed thereto, it is known to weld the tubular sleeve to the base. Welding techniques may include laser welding and electron beam welding and other per se known welding techniques. In order to hermetically seal the attachment between a sleeve and the base, the weld is typically formed as a continuous circle surrounding the tubular sleeve. However, especially at the end of the weld line, where the welding process stops, there is a geometric irregularity in the weld line causing a protrusion or recess above and/or below the surface of the tubular sleeve as well as a variation in the width of the weld line. This variation is due to the effect of the change in energy as the weld process stops on the formation and distribution of the molten material during the weld process. This weld irregularity creates gives the impression of a possible defect in the material coupling between the base and tubular sleeve that may lead to unacceptable defects in certain ammunition cartridges in view of the high pressures exerted on firing and the accuracy of the fit of the cartridge within the corresponding chamber in a weapon.

In view of the foregoing, an object of the invention is to provide an ammunition with multi-part casings that are accurate, reliable, safe to use and economical to manufacture.

It is advantageous to provide ammunition with multi-part casings that have a low weight, yet that can withstand high pressures and harsh environments reliably.

Objects of the invention have been achieved by providing an ammunition cartridge according to claim 1. Dependent claims set forth various advantageous features.

Disclosed herein is a multi-part casing for an ammunition cartridge comprising a tubular sleeve and a base, the base assembled and fixed to the tubular sleeve by a weld arrangement. The base comprises an end wall having a rim, an extraction groove adjacent the rim, and a tubular extension extending from the end wall and having an outer surface in contact with an inner surface of a base end of the tubular sleeve.

The welding arrangement comprises a weld line that spirals around the base end of the tubular sleeve from a weld line start point positioned over the tubular extension of the base spiraling to a weld line end section positioned over the extraction groove, a surface portion of the extraction groove interfacing with the tubular sleeve having a machined surface such that the weld line ends in the machined surface.

In an advantageous embodiment, the weld line winds around the casing at least two turns.

In an advantageous embodiment, the weld line winds around the casing at least three turns.

In an advantageous embodiment, the weld line spire has a pitch P in the range in the range of 1.2 to 3 times the weld line thickness T: $1.2\times T<P<3\times T$.

In an advantageous embodiment, the tubular sleeve and base are made of stainless steel.

In an advantageous embodiment, the weld line start point is at a distance S1 in a range of 0.3 to 0.8 times the diameter D2 of the tubular sleeve $0.3\times D2<S1<0.8\times D2$, preferably in a range of 0.4 to 0.5 times the diameter of the tubular sleeve.

35 In an advantageous embodiment, the weld line start point is at a distance S1 in a range of 0.3 to 0.5 times the diameter D2 of the tubular sleeve $0.4\times D2<S1<0.5\times D2$, In an advantageous embodiment, the weld line is formed by a laser weld.

Also disclosed herein is an ammunition cartridge comprising a casing according to any of the above embodiments, a propellant mounted in the casing and a projectile mounted on an open end of the casing.

Also disclosed herein is a method of producing a casing according to the above embodiment, comprising

- inserting the tubular sleeve base end over the tubular extension of the base until abutment with the rim,
- welding the weld line starting at a point distal from the rim and welding in a spire around the casing towards the rim and ending the welding process at a weld line end point situated over the extraction groove,
- machining a portion of the tubular sleeve extending over the extraction groove and thereby removing a portion of the weld line including the weld line end.

In an advantageous embodiment, the weld is generated by a laser welding process.

In an advantageous embodiment, the weld line end is deviated out of the spire in an axial direction.

In an advantageous embodiment, the weld line is generated around the tubular sleeve by two or more turns at a pitch between 1.2 and 3 times the thickness of the weld line.

In an advantageous embodiment, the welding beam energy level at an end of the welding process where the weld line extends over the extraction groove is increased to a level adapted to cut the tubular sleeve.

Figure 2A:
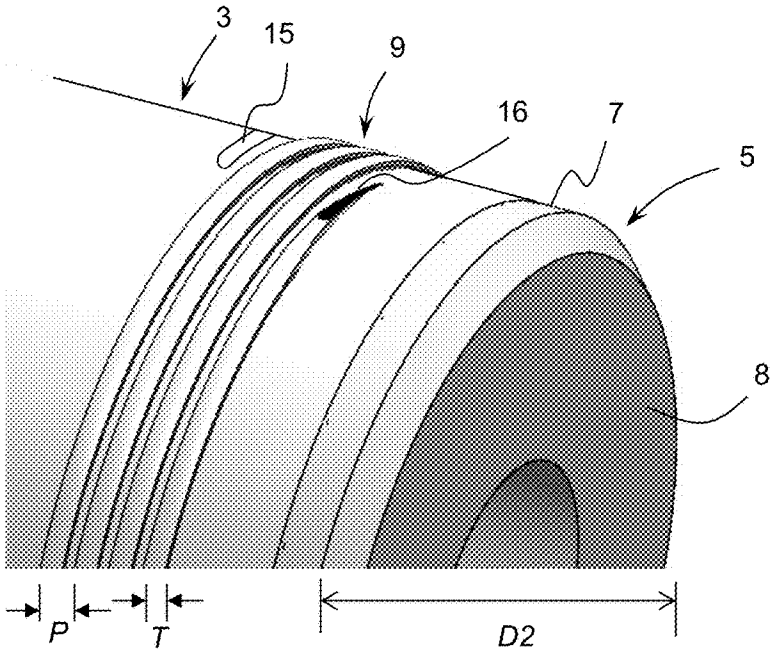
Figure 2B:
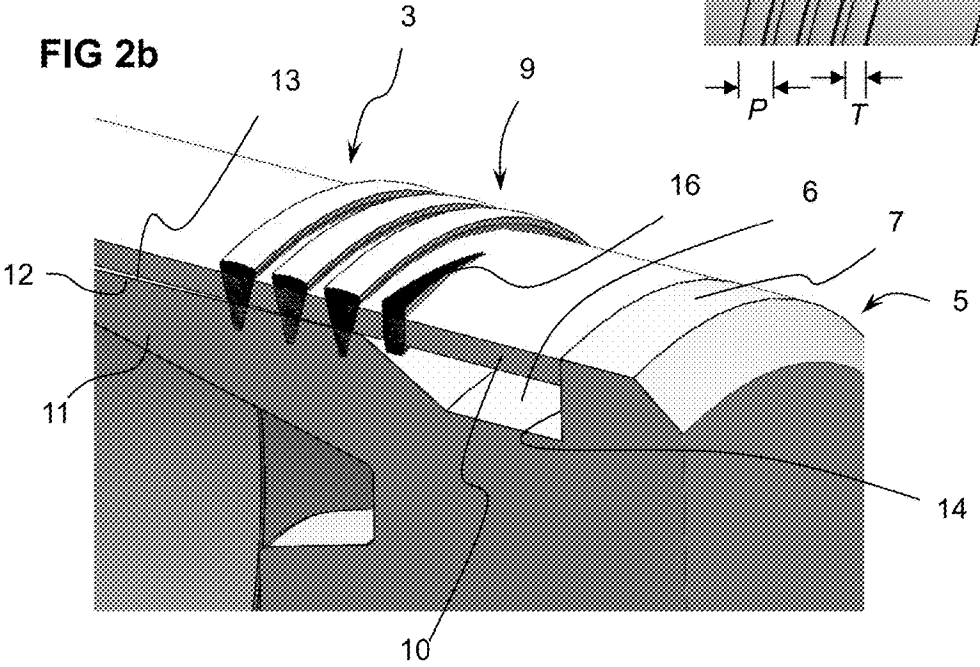

Further objects and advantageous features of the invention will be apparent from the claims, from the detailed description, and annexed drawings, in which:

FIG. 1 is a cross-sectional view of an ammunition cartridge according to an embodiment of the invention;

FIG. 2*a* is a view in perspective in detail of a part of the ammunition cartridge of the embodiment of FIG. 1, showing a base end during a process of manufacturing;

FIG. 2*b* is a detailed cross-sectional view of a portion of the base end of FIG. 2*a;*

Figure 2C:
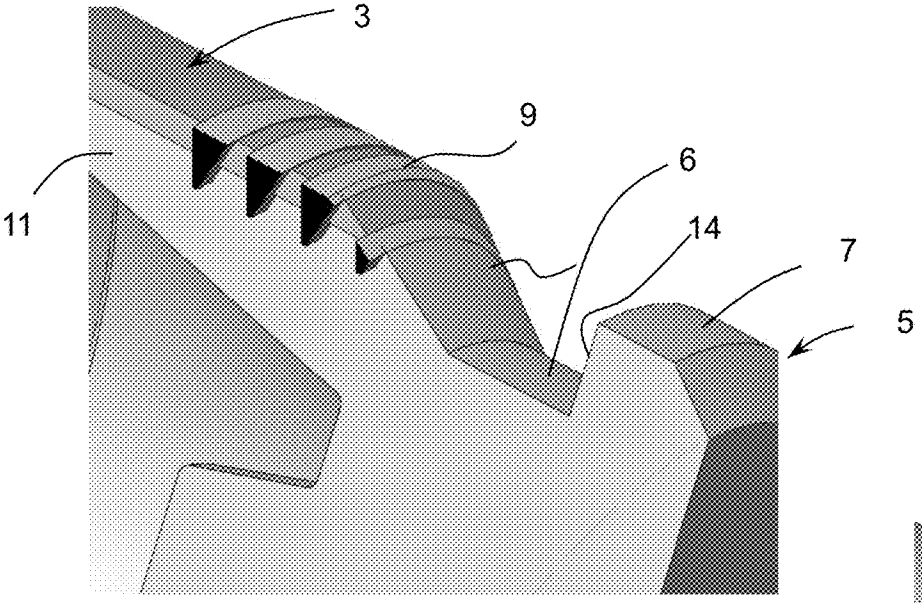
Figure 2D:
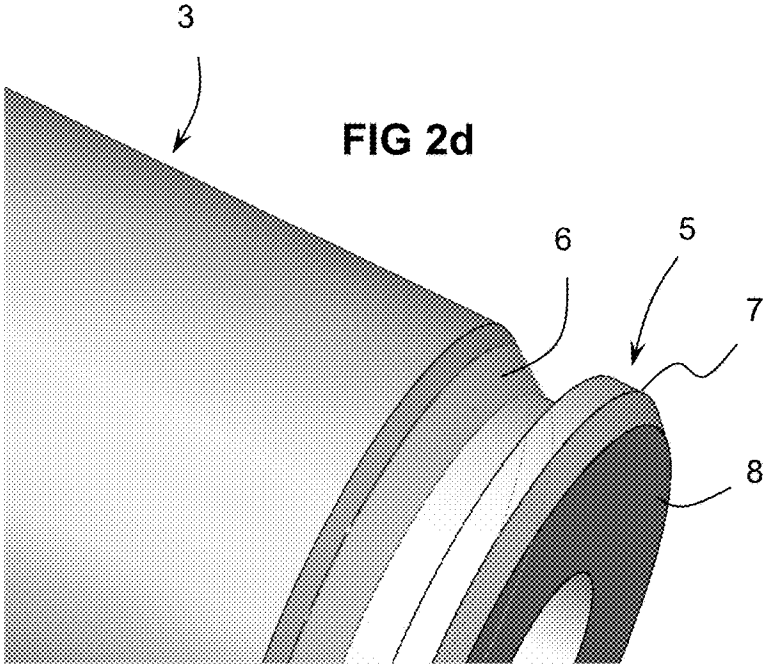
Figure 3A:
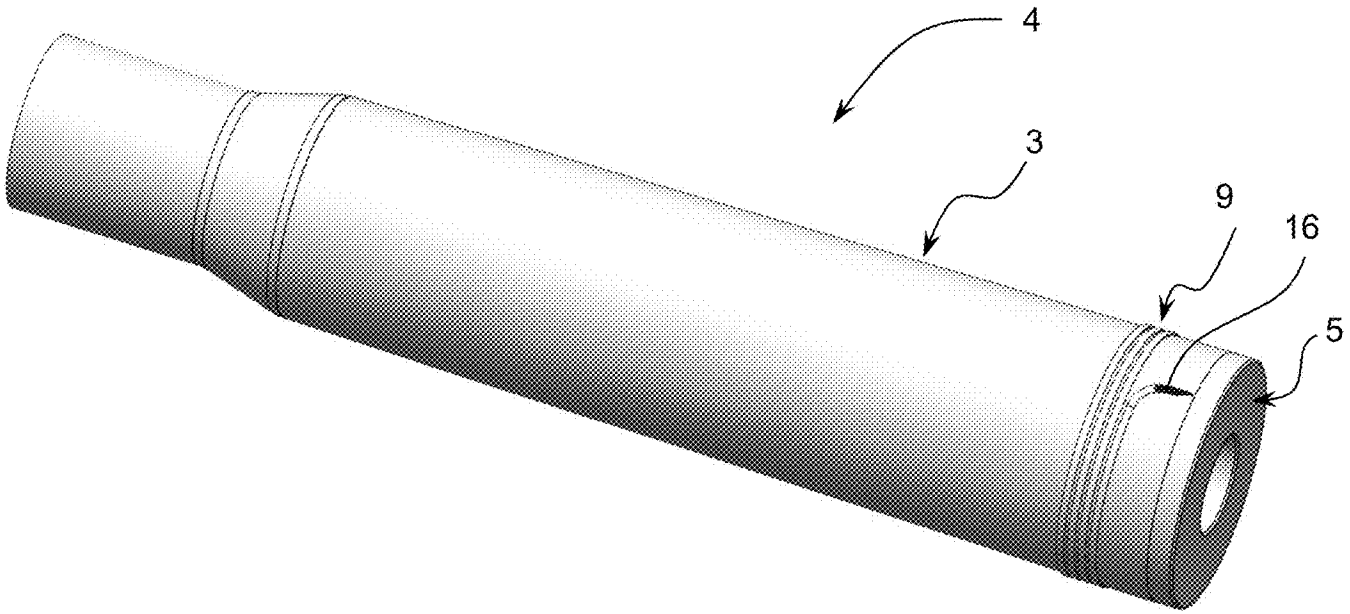
Figure 3B:
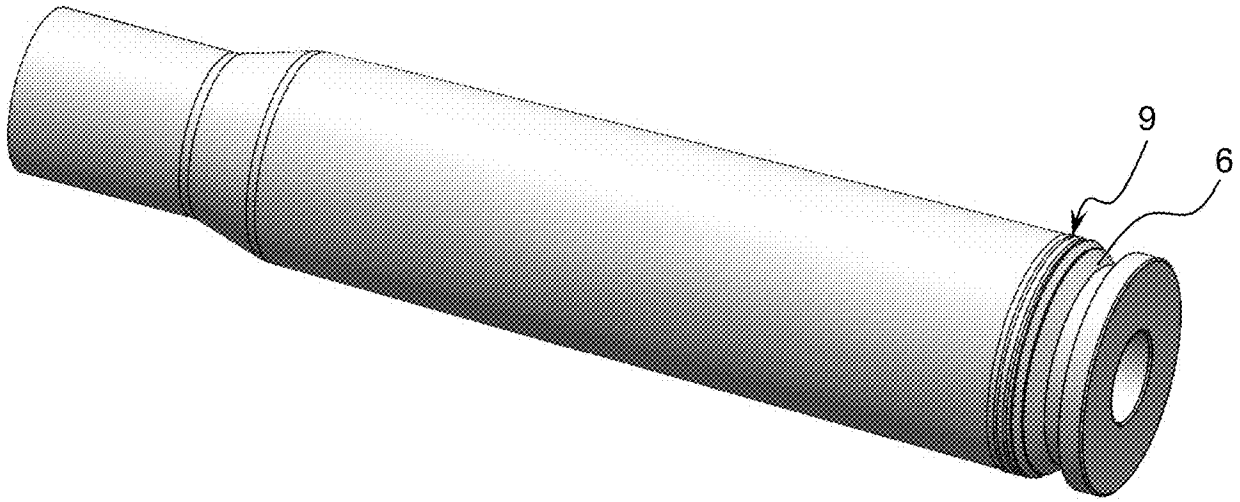

FIG. 2*c* is a view similar to FIG. 2*b* in a subsequent manufacturing step;

FIG. 2*d* is a view similar to FIG. 2*c* in perspective and after a final manufacturing step;

FIG. 3*a* is a perspective view of a cartridge casing during the manufacturing process, illustrating an end of the weld line;

FIG. 3*b* is a view similar to FIG. 3*a* in a subsequent manufacturing step where an end portion of the casing has been machined away according to another embodiment of the invention.

Referring to the figures, an ammunition cartridge 1 comprises a casing 4, a propellant 30 contained within the casing, and a projectile 31 partially inserted within an open tubular end of the casing as per se well known. The casing according to embodiments of the invention has two parts, a base 5 and a tubular sleeve 3 fixed to the base. An ignition device 32 is mounted in the base also as per se well known.

The base 5 comprises an end wall 8 within which the ignition device is mounted, the end wall defining at its outer periphery a rim 7. Adjacent the rim 7, the base comprises an extraction groove 6 as per se well known in conventional ammunition cartridges with rims and extraction grooves. The extraction groove and rim serve to hold and eject the cartridge from the chamber of the weapon after firing. The base 5 further comprises a tubular extension 11 forming on its outer periphery a cylindrical surface over a length L1 onto which a base end 10 of the tubular sleeve 3 is assembled. The tubular sleeve base end 10 may be inserted over the tubular extension 11 of the base 5 whereby the inner surface 13 of the tubular sleeve is in contact and in a close fit with the outer surface 12 of the tubular extension of the base. The diameter D1 of the outer surface 12 of the tubular extension may, in various embodiments, be configured for the wall thickness of the tubular sleeve 3 such that an outer diameter of the tubular sleeve is aligned with an outer diameter of the rim 7.

During assembly of the tubular sleeve to the base 5, the tubular sleeve base end 10 is inserted until it abuts against the forward facing surface 14 of the rim 7. The tubular sleeve is then welded to the base, starting the weld process over the tubular extension 11 at a start point 15 distal from the rim forward facing surface 14. The axial distance S1 of the starting point 15 of the weld from the rim forward facing surface 14 is preferably in a range of 0.3 to 0.8 times the diameter D2 of the tubular sleeve $0.3\times D2<S1<0.8\times D2$, more preferably in a range of 0.3 to 0.5. The weld is then formed in a spiral, whereby the cartridge is rotated relative to the welding spot generator and simultaneously a relative movement in the axial direction A such that the spiral winds towards the rim 7. The welding operation is stopped at a weld line end point 16 positioned on a portion of the base end of the tubular sleeve positioned overhead the extraction groove 6.

The portion of tubular sleeve extending over the extraction groove 6 is subsequently machined away by a cutting or grinding tool in a turning, milling, or grinding operation. It may be noted that the extraction groove may be completely or partially formed before this operation, or may be formed during the machining away of the portion of tubular sleeve over the extraction groove simultaneously therewith.

Subsequent to the machining operation, a polishing operation may optionally be performed to polish the base end 10 of the tubular sleeve 3 and extraction groove 6. Subsequent to the polishing operation, the weld line may no longer be visible to the naked eye.

The pitch P of the weld line spires may advantageously be in the range of 1.2 to 3 times the weld line thickness T ($1.2\times T<P<3\times T$), which may typically lie in the range of 0.5 to 2 mm.

In advantageous embodiments, the weld line is produced by a laser welding process. In alternative embodiments, the weld line may be produced by an electron beam welding process.

In preferred embodiments, the weld line winds around the casing at least two turns preferably at least three turns.

In preferred embodiments, the casing tubular sleeve and base wall are made of a stainless steel. The casing tubular sleeve may be extruded or formed from a flat sheet that is folded into a tube and welded along an axial seam.

Referring to FIGS. 3*a* and 3*b*, in an alternative embodiment, the weld line during the welding process may have an end section that extends in the axial direction towards the rim 7 to the end point 16. The end section of the weld line 9 is thus directed to a portion of the tubular sleeve that is subsequently removed in a subsequent machining step.

In an advantageous embodiment, the laser beam energy can be set at such an energy level at the end of the welding process that it cuts the tubular sleeve in the region extending over the extraction groove, making it easier to remove the part of the sleeve 3 overlapping the extraction groove 6.

LIST OF REFERENCES USED

- Ammunition cartridge 1
  - Projectile 30
  - Propellant 31
  - Ignition device 32
  - Casing 4
    - tubular sleeve 3
      - base end 10
        - inner surface 12
      - projectile end
    - base 5
      - extraction groove 6
      - rim 7
        - forward facing surface 14
      - end wall 8
      - tubular extension 11
        - outer surface 13
    - weld arrangement
      - weld line 9
        - weld line start point 15
        - weld line end point 16
- axial direction A
- tubular extension length L1
- tubular extension outer surface diameter D1
- tubular sleeve diameter D2
- weld line starting point axial distance S1
- weld line spires pitch P
- weld line thickness T

The invention claimed is:

1. Multi-part casing for an ammunition cartridge comprising a tubular sleeve and a base, the base assembled and fixed to the tubular sleeve by a weld arrangement, the base comprising an end wall having a rim, an extraction groove adjacent the rim, and a tubular extension extending from the end wall and having an outer surface in contact with an inner surface of a base end of the tubular sleeve, wherein the welding arrangement comprises a weld line that spirals around the base end of the tubular sleeve from a weld line start point positioned over the tubular extension of the base spiraling to a weld line end section positioned over the extraction groove, a surface portion of the extraction groove interfacing with the tubular sleeve having a machined surface such that the weld line ends in the machined surface.

2. Casing according to claim 1, wherein the weld line winds around the casing at least two turns.

3. Casing according to claim 2, wherein the weld line winds around the casing at least three turns.

4. Casing according to claim 1, wherein the weld line spire has a pitch P in the range in the range of 1.2 to 3 times the weld line thickness T: $1.2 \times T < P < 3 \times T$.

5. Ammunition cartridge comprising a casing according to claim 4, a propellant mounted in the casing and a projectile mounted on an open end of the casing.

6. Casing according to claim 1, wherein the tubular sleeve and base are made of stainless steel.

7. Ammunition cartridge comprising a casing according to claim 6, a propellant mounted in the casing and a projectile mounted on an open end of the casing.

8. Casing according to claim 1, wherein the weld line start point is at a distance S1 in a range of 0.3 to 0.8 times the diameter D2 of the tubular sleeve $0.3 \times D2 < S1 < 0.8 \times D2$, preferably in a range of 0.4 to 0.5 times the diameter of the tubular sleeve.

9. Casing according to claim 8, wherein the weld line start point is at a distance S1 in a range of 0.3 to 0.5 times the diameter D2 of the tubular sleeve $0.4 \times D2 < S1 < 0.5 \times D2$.

10. Ammunition cartridge comprising a casing according to claim 8, a propellant mounted in the casing and a projectile mounted on an open end of the casing.

11. Casing according to claim 1, wherein the weld line is formed by a laser weld.

12. Ammunition cartridge comprising a casing according to claim 1, a propellant mounted in the casing and a projectile mounted on an open end of the casing.

13. Method of producing a casing according to claim 1, comprising:

inserting the tubular sleeve base end over the tubular extension of the base until abutment with the rim, welding the weld line starting at a point distal from the rim and welding in a spire around the casing towards the rim and ending the welding process at a weld line end point situated over the extraction groove, machining a portion of the tubular sleeve extending over the extraction groove and thereby removing a portion of the weld line including the weld line end.

14. Method according to claim 13, wherein the weld is generated by a laser welding process.

15. Method according to claim 13, wherein the weld line end is deviated out of the spire in an axial direction.

16. Method according to claim 13, wherein the weld line is generated around the tubular sleeve by two or more turns at a pitch between 1.2 and 3 times the thickness of the weld line.

17. Method according to claim 13, wherein a welding beam energy level at an end of the welding process where the weld line extends over the extraction groove is increased to a level sufficient to cut the tubular sleeve.

* * * * *